US005424973A

United States Patent [19]

Shou et al.

[11] Patent Number: 5,424,973

[45] Date of Patent: Jun. 13, 1995

[54] APPARATUS AND METHOD FOR PERFORMING SMALL SCALE SUBTRACTION

[75] Inventors: Guoliang Shou; Weikang Yang; Sunao Takatori; Makoto Yamamoto, all of Tokyo, Japan

[73] Assignee: Yozan Inc., Tokyo, Japan

[21] Appl. No.: 151,307

[22] Filed: Nov. 12, 1993

[30] Foreign Application Priority Data

Nov. 12, 1992 [JP] Japan ..... 4-327408

[51] Int. Cl.[6] ..... G06G 7/00

[52] U.S. Cl. ..... 364/807

[58] Field of Search ..... 364/807, 841, 602, 606; 307/529

[56] References Cited

U.S. PATENT DOCUMENTS 3,745,372 7/1973 Koster ..... 307/584 X
4,422,155 12/1983 Amir et al. ..... 364/606
5,221,907 6/1993 Olsen et al. ..... 307/529 X
5,289,141 2/1994 Nanni et al. ..... 332/101

OTHER PUBLICATIONS

Iwai, "The Beginning of Logical Circuit", The Electrical Engineering Handbook, 1993, pp. 625–631.

*Primary Examiner*—Tan V. Mai
*Attorney, Agent, or Firm*—Cushman, Darby & Cushman

[57] ABSTRACT

A subtracting circuit which is capable of performing highly accurate, small scale subtraction. The subtracting circuit includes a first input capacitance receiving a first input voltage, a first set of inverters connected with an output terminal of the first input capacitance, a second input capacitance connected with an output terminal of the first set of inverters and receiving a second input voltage, and a second set of inverters connected with an output terminal of the second input capacitance, each set of inverters having capacitive feedback. The subtracting result is output from the second set of inverters.

2 Claims, 1 Drawing Sheet

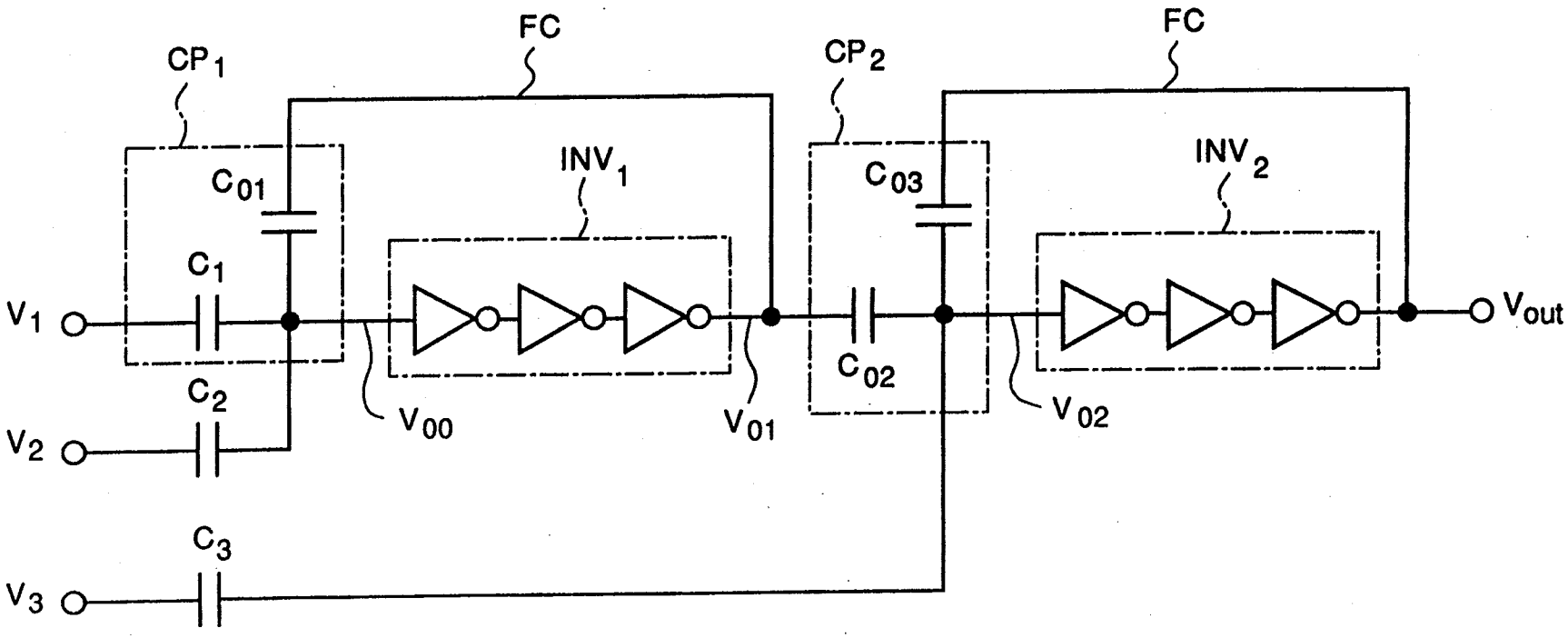
$V_{out}$
FC
$INV_2$
$V_{02}$
$CP_2$
$C_{03}$
$C_{02}$
$V_{01}$
FC
$INV_1$
$V_{00}$
$CP_1$
$C_{01}$
$C_1$
$C_2$
$C_3$
$V_1$
$V_2$
$V_3$

APPARATUS AND METHOD FOR PERFORMING SMALL SCALE SUBTRACTION

FIELD OF THE INVENTION

The present invention relates to a subtracting circuit.

BACKGROUND OF THE INVENTION

Conventionally, a digital type subtracting circuit operate on a large scale and an analog type subtracting circuit operates with low accuracy in its calculation.

SUMMARY OF THE INVENTION

The present invention is invented so as to solve the conventional problems. It has a purpose to provide a subtracting circuit capable of performing a subtracting calculation on a small scale with high accuracy. Calculation through this subtracting circuit is therefore easily available for various kinds of calculation manners.

According to the present invention, an inverter is serially connected to an output terminal of two inputs which are coupled capacitively at an input terminal. Another inverter is connected to an output terminal of the above inverter as well as to an output terminal or another dual input capacitive coupling circuit. Accordingly the latter inverter outputs a subtraction result.

BRIEF DESCRIPTION OF THE DRAWINGS

FIG. 1 is a circuit diagram showing an embodiment of the present invention.

PREFERRED EMBODIMENT OF THE INVENTION

Hereinafter, an embodiment of a subtracting circuit according to the present invention is described with referring to the attached drawings.

In FIG. 1, a subtracting circuit is composed of the first dual input capacitive coupling circuit $CP_1$, the second dual input capacitive coupling circuit $CP_2$, the first inverter $INV_1$ and the second inverter $INV_2$.

In the first dual input capacitive coupling circuit $C_{P1}$, a voltage $V_1$ and a voltage $V_{01}$ are respectively input to capacitors $C_1$ and $C_{01}$. Voltage $V_2$ is input through a capacitance $C_2$.

$C_{P1}$ is composed of capacitances $C_1$ and $C_{01}$ which are parallelly connected with the first inverter $INV_1$. A capacitance $C_2$ is also connected with $INV_1$. A feedback circuit FC is provided for feeding an output of inverter $INV_1$ back to its input through a capacitance $C_{01}$, in order to get an effect of a summing amplifier.

When voltages for impressing $C_1$, $C_{01}$ and $C_2$ are $V_1$, $V_{01}$ and $V_2$, respectively, an input voltage $V_{00}$ for $INV_1$ is defined as following formula (1).

$$V_{00} = \frac{(C_1V_1 + C_2V_2 + C_{01}V_{01})}{(C_1 + C_2 + C_{01})} \quad (1)$$

$INV_1$ is composed of 3 inverters serially connected. An output of the first inverter changes to low level when $V_{00}$ exceeds a threshold voltage. An output of the next inverter changes to high level. Then, an output of the last inverter changes to low level. When the output voltage is defined as $V_{01}$, $V_{01}$ can be obtained by formula (2).

$$V_{01} = -A_1V_{00} \quad (2)$$

where A1 is an open loop gain.

When formula (2) is input to formula (1) after transforming the formula, formulas (3) and (4) can be obtained.

$$-\frac{V_{01}}{A_1}(C_1 + C_2 + C_{01}) = C_1V_1 + C_2V_2 + C_{01}V_{01} \quad (3)$$

$$-V_{01}\left(\frac{C_1 + C_2 + C_{01}}{A_1} + C_{01}\right) = C_1V_1 + C_2V_2 \quad (4)$$

Here, the first term in parentheses of formula (4) can be omitted as it is negligible compared with the second term of it. So formula (4) is substantially defined as formula (5).

$$V_{01} = -\frac{C_1V_1 + C_2V_2}{C_{01}} \quad (5)$$

In the second dual input capacitive coupling circuit $C_{p2}$, voltage $V_{01}$ and a voltage $V_{out}$ from an output terminal of $INV_2$ are input, voltage $V_3$ is also input through a capacitance $C_3$. Capacitances $C_{02}$ and $C_{03}$ are parallelly connected within $C_{P2}$ for input to the second inverter $INV_2$. Capacitance $C_3$ is connected to $INV_2$ in parallel with $C_{02}$ and $C_{03}$.

A feedback circuit FC feeds an output from inverter $INV_2$ back to its input through a capacitance $C_{03}$ in order to get an effect of summing amplifier.

Voltage which are applied to $C_{02}$, $C_{03}$ and $C_3$ are $V_{01}$, $V_{OUT}$ so that $V_3$, respectively, and an input voltage $V_{02}$ for $INV_2$ is defined as following formula (6).

$$V_{02} = \frac{(C_3V_3 + C_{02}V_{01} + C_{03}V_{out})}{(C_3 + C_{02} + C_{03})} \quad (6)$$

An inverter $INV_2$ is composed of 3 inverters by serial connecting, similar to $INV_1$. An output of the first inverter changes to low level when $V_{02}$ exceeds a threshold voltage. An output of the next inverter changes to high level. Then an output of the last inverter changes to low level. When the output voltage is defined $V_{out}$, then formula (7) is obtained, according to the same reason of above formulas from (2) to (5).

$$V_{out} = -\frac{C_{02}V_{01} + C_3V_3}{C_{03}} \quad (7)$$

Here, inputting formula (5) to formula (7) and transforming it, formulas (8) and (9) are obtained.

$$V_{out} = -\frac{-C_{02}\frac{C_1V_1 + C_2V_2}{C_{01}} + C_3V_3}{C_{03}} \quad (8)$$

$$= \frac{-C_3V_3 + \frac{C_{02}}{C_{01}}C_1V_1 + \frac{C_{02}}{C_{01}}C_2V_2}{C_{02}} \quad (9)$$

Here if $C_{01}$ is equal to $C_{02}$, then formula (10) is obtained.

$$V_{out} = \frac{C_1V_1 + C_2V_2 - C_3V_3}{C_{03}} \quad (10)$$

As a result, subtraction result is substantially obtained.

As mentioned above, an inverter is serially connected to an output terminal of the dual input capacitive coupling circuit provided at an input terminal, another inverter is connected to an output terminal of the above inverters as well as to an output terminal of another capacitive coupling circuit connected with another two inputs of voltage. The latter inverter outputs a subtraction result, so that the present invention has a purpose to provide a subtracting circuit capable of subtracting calculation with small scale and high accuracy and easily realize a various kinds of manners of calculations.

What is claimed is:

1. A subtracting circuit comprising:

a first input capacitance for receiving a first input voltage;

a first set of inverters having an input coupled to said first input capacitance, said first set of inverters being series connected and consisting of an odd number of inverters;

a second input capacitance for receiving a second input voltage;

a connecting capacitance having a first terminal coupled to an output of said first set of inverters and a second terminal coupled to said second input capacitance, said second terminal of said connecting capacitance developing a voltage indicative of a difference between said first input voltage and said second input voltage;

a second set of inverters having an input coupled with said second terminal of said connecting capacitance for generating a subtracted output voltage, said second set of inverters being series connected and consisting of an odd number of inverters;

a first feed-back capacitance connecting said input and said output of said first set of inverters; and a second feed-back capacitance connecting said input and an output of said second set of inverters.

2. A method for subtracting voltage signals comprising the steps of:

inputting at least one first voltage signal;

generating a coupled first voltage signal based on said first input voltage signal using a capacitor;

inverting said coupled first voltage signal with a first set of serially connected inverters to generate an inverted first voltage signal;

coupling first feedback voltage with said coupled first voltage signal, said first feedback voltage being based on said inverted first voltage signal;

inputting at least one second voltage signal;

coupling said inverted first voltage signal and said second input voltage signal using a capacitor to generate a third voltage signal which is indicative of a difference between said input voltage signals;

inverting said third voltage signal with a second set of serially connected inverters to generate an output voltage signal which is based on a difference between said first and said second voltage signals input; and coupling second feedback voltage with said third voltage signal, said second feedback voltage being based on said output voltage signal.

* * * * *